US008662041B2

(12) United States Patent
Bogershausen

(10) Patent No.: US 8,662,041 B2
(45) Date of Patent: Mar. 4, 2014

(54) DEVICE FOR VARIABLE ADJUSTMENT OF THE CONTROL TIMES OF GAS EXCHANGE VALVES OF AN INTERNAL COMBUSTION ENGINE

(75) Inventor: Mathias Bogershausen, Puschendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 3 days.

(21) Appl. No.: 13/578,919

(22) PCT Filed: Jan. 20, 2011

(86) PCT No.: PCT/EP2011/050745

§ 371 (c)(1),
(2), (4) Date: Aug. 14, 2012

(87) PCT Pub. No.: WO2011/098330

PCT Pub. Date: Aug. 18, 2011

(65) Prior Publication Data

US 2012/0304947 A1 Dec. 6, 2012

(30) Foreign Application Priority Data

Feb. 15, 2010 (DE) ..... 10 2010 008 002

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS 6,684,834 B2 * 2/2004 Kohrs ..... 123/90.17

FOREIGN PATENT DOCUMENTS

| | | |
|---|---|---|
| DE | 10228354 | 1/2004 |
| DE | 102005060111 | 7/2007 |
| DE | 102006033425 | 2/2008 |
| DE | 102008029692 | 1/2010 |
| DE | 102008032412 | 1/2010 |
| WO | 02095194 | 11/2002 |
| WO | 2008140897 | 11/2008 |

* cited by examiner

*Primary Examiner* — Zelalem Eshete
(74) *Attorney, Agent, or Firm* — Volpe and Koenig, P.C.

(57) ABSTRACT

A device (11) for variable adjustment of the control times of gas change valves (9, 10) of an internal combustion engine (1) having a hydraulic phase adjustment apparatus (12), a camshaft (6, 7), a volume accumulator (18), a first fastening element (14) designed separately to the camshaft (6, 7) and a central screw (13), wherein the central screw (13) extends through the phase adjustment device (12) and wherein one end of the central screw (13) contacts an axial side surface of the phase adjustment device (12) and a first thread (15) is constructed on the other end.

7 Claims, 2 Drawing Sheets

DEVICE FOR VARIABLE ADJUSTMENT OF THE CONTROL TIMES OF GAS EXCHANGE VALVES OF AN INTERNAL COMBUSTION ENGINE

FIELD OF THE INVENTION

The invention relates to a device for the variable adjustment of the control times of gas exchange valves of an internal combustion engine with a hydraulic phase adjustment device, a camshaft, a volume accumulator, a fastening element constructed separately from the camshaft, and a central screw, wherein the central screw penetrates the phase adjustment device and wherein an end of the central screw contacts an axial side surface of the phase adjustment device and a first thread is constructed on the other end.

BACKGROUND

In modern internal combustion engines, devices for the variable adjustment of the control times of gas exchange valves are used to be able to vary the phase relation between the crankshaft and camshaft in a defined angle range between a maximum advanced position and a maximum retarded position. The device is integrated in a drive train by means of which torque is transmitted from the crankshaft to the camshaft. This drive train can be realized, for example, as a belt, chain, or gearwheel drive. In addition to the camshaft, the device has a phase adjustment device and a central screw by means of which the phase adjustment device is locked in rotation with the camshaft. The phase adjustment device can be constructed, for example, as an oscillating drive in a vane cell construction with several pressure chambers acting against each other. By adding pressurized medium to a group of pressure chambers while simultaneously discharging pressurized medium from the other group of pressure chambers, the phase relation of the impeller relative to the cell wheel and thus the camshaft relative to the crankshaft can be varied. The pressurized medium flow to and from the pressure chambers is typically regulated by means of a hydraulic proportional directional control valve that can be mounted, for example, within the central screw.

Such a device is known, for example, from DE 10 2005 060 111 A1. In this embodiment, the central screw is screwed with a solid camshaft, in order to realize the rotationally locked connection between the phase adjustment device and the camshaft.

From DE 10 2004 026 863 A1, another device is known. In this embodiment, the phase adjustment device is mounted on an installed camshaft that consists of a tube and cams attached to this tube. In this embodiment, the attachment of the phase adjustment device to the camshaft can be realized only with difficulty due to the camshaft constructed as a hollow tube. For this reason, the phase adjustment device is locked in rotation on the camshaft by means of a weld connection.

Another device is known from DE 102 28 354 A1. In this embodiment, a hollow space that is used as a volume accumulator is provided within the solid camshaft. In operating phases of the internal combustion engine in which sufficient pressurized medium is made available from a pressurized medium pump of the internal combustion engine for operating the phase adjustment device, the volume accumulator fills with pressurized medium. If the demand for pressurized medium of the phase adjustment device increases past the volume flow provided by the pressurized medium pump, the volume accumulator supports the phase adjustment device.

SUMMARY

The present invention is based on the objective of specifying a device with high response behavior and low manufacturing expense.

This objective is met according to the invention in that the interior of the camshaft has a hollow space in which the fastening element is mounted fixed in position, wherein a second thread is formed on the fastening element and this second thread interacts with the first thread of the central screw such that a rotationally locked connection between the device and the camshaft is produced and wherein, in the hollow space, a volume accumulator with a housing is arranged, wherein an axial end of the housing contacts a contact surface of the fastening element.

The device has a hydraulic phase adjustment device, a camshaft, a central screw, and a first fastening element. The phase adjustment device is in driven connection with a crankshaft and is locked in rotation with the camshaft by means of the central screw. For this purpose, the central screw penetrates the phase adjustment device, wherein one end of the central screw, for example, a collar, contacts an axial side surface of the phase adjustment device and a first thread, usually an external thread, is formed on the other end. By pressurizing the phase adjustment device with pressurized medium, a phase of the camshaft can be varied relative to the crankshaft. The camshaft has a hollow space in which the fastening element constructed separately from the camshaft is mounted fixed in position, i.e., it cannot be moved in the axial direction or in the peripheral direction under normal loads. The fastening element can be screwed, for example, with the lateral surface of the hollow space. Also conceivable is a non-positive-fit connection. The fastening element has a second thread, usually an internal thread, in which the central screw is screwed, so that the phase adjustment device is locked in rotation with the camshaft. In addition, the device has a volume accumulator that is arranged in the camshaft. The volume accumulator is filled with pressurized medium in phases in which sufficient pressurized medium is available for operating the phase adjustment device. In phases of the insufficient supply of pressurized medium to the phase adjustment device, the pressurized medium stored in the volume accumulator is provided. The volume accumulator has a housing in which the pressurized medium can be stored. In the interior of the housing, for example, a moveable, spring-loaded piston, a flexible membrane, or a bubble filled with gas can be arranged that are used as force accumulators. Here, it is provided that an axial end of the housing contacts a contact surface, usually an axial side surface, of the fastening element. In addition, the housing could be connected to the fastening element. The fastening element is thus used, on one hand, for producing the rotationally locked connection between the phase adjustment device and the camshaft by means of the central screw, wherein, through the use of the fastening element, this connection method can also be used for relatively thin-walled, installed camshafts. In addition, the fastening element is used for the axial position fixing of the housing of the volume accumulator.

During the installation of the device, initially the fastening element is positioned and fixed in the hollow space of the camshaft. Then the phase adjustment device is locked in rotation with the camshaft by means of the central screw and the volume accumulator is inserted into the camshaft from the end facing away from the phase adjustment device. Then this end of the camshaft is closed with a second fastening element, wherein the second fastening element forces the volume accumulator against the first fastening element, so that the volume accumulator is fixed in the axial direction.

In one refinement of the invention, it is proposed for the contact surface to have a conical form in the direction of the housing. In this way, the housing of the volume accumulator is centered during the installation of the second fastening element, so that the housing is automatically oriented coaxial to the axis of rotation of the camshaft. For this purpose, advantageously a conical contact surface is likewise provided on the second fastening element. Through the centering of the housing in the hollow space of the camshaft, a ring gap is produced between the housing and the lateral surface of the hollow space, wherein this gap can be used for supplying lubricant to the camshaft bearing points.

It can also be provided that the first fastening element or the central screw has a pressurized medium channel that runs in the axial direction and opens on the side of the fastening element turned away from the phase adjustment device into the hollow space, for example, the ring gap. Here, the pressurized medium channel can be constructed, for example, as a borehole within the central screw or on an outer lateral surface of the fastening element. It can also be provided that the pressurized medium channel communicates with the volume accumulator or with a camshaft bearing point.

Thus the fastening element takes on not only the functions of fastening the phase adjustment device to the camshaft and the volume accumulator to the camshaft, but also forms, in a simple, cost-neutral way, parts of the pressurized medium supply system within the device and adjacent assemblies. This reduces the number of components required and the complexity of the device considerably.

BRIEF DESCRIPTION OF THE DRAWINGS

Additional features of the invention can be found in the following description and from the drawings in which an embodiment of the invention is shown in simplified form.

Shown Are.

DETAILED DESCRIPTION OF THE PREFERRED EMBODIMENTS

Figure 1:
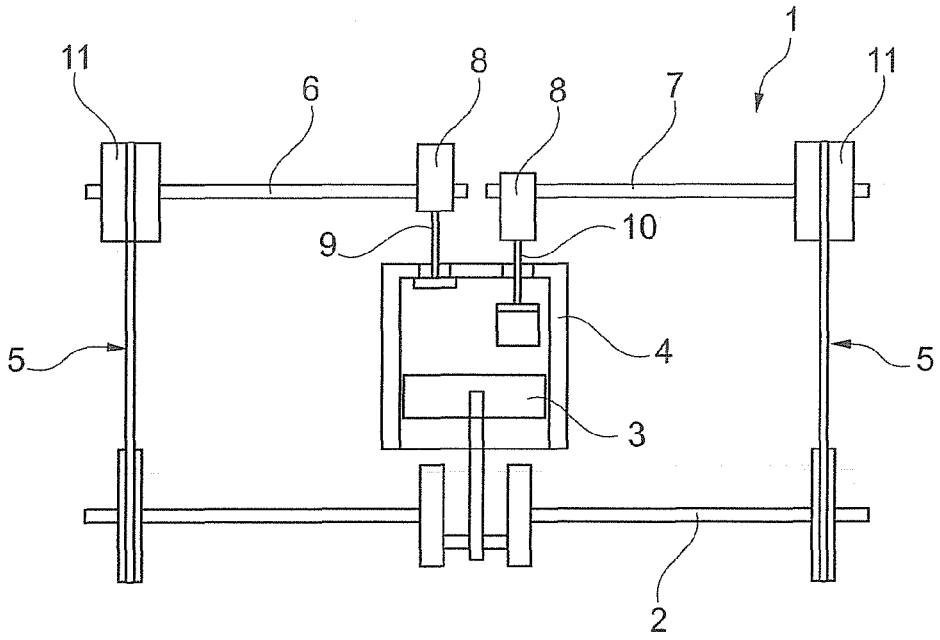
FIG. 1 only very schematically, an internal combustion engine.

In FIG. 1, an internal combustion engine 1 is sketched, wherein a piston 3 sitting on a crankshaft 2 is indicated in a cylinder 4. The crankshaft 2 connects to an intake camshaft 6 or exhaust camshaft 7 in the shown embodiment by means of a traction mechanism drive 5, wherein a first and a second device 11 can provide for a relative rotation between the crankshaft 2 and the camshafts 6, 7. The cams 8 of the camshafts 6, 7 actuate one or more intake gas exchange valves 9 and one or more exhaust gas exchange valves 10, respectively. It can also be provided to equip only one of the camshafts 6, 7 with a device or to provide only one camshaft 6, 7 that is provided with a device 11.

Figure 2:
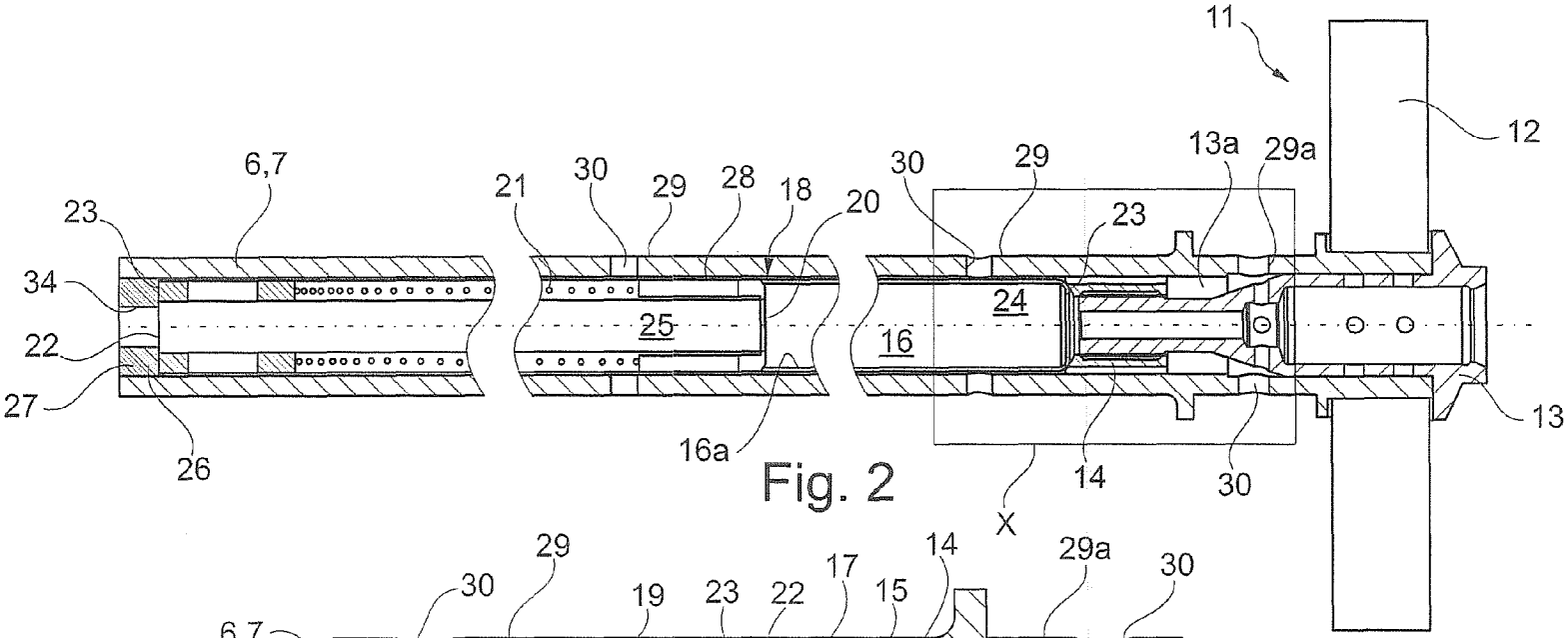
FIG. 2 a longitudinal section view through a device according to the invention, FIG. 3 an enlarged view of the detail X from FIG. 2, and FIG. 4 a perspective view of a fastening element.

FIG. 2 shows a first embodiment of a device 11 according to the invention in a longitudinal section and cross section, respectively. The device 11 has a phase adjustment device 12, a camshaft 6, 7, a central screw 13, and a first fastening element 14. The phase adjustment device 12 is constructed as a hydraulic adjustment drive, wherein this is set in rotation by the crankshaft 2 by means of a traction mechanism or gearwheel drive 5 and is locked in rotation with the camshaft 6, 7. By supplying pressurized medium to a group of not-shown pressure chambers of the hydraulic adjustment drive of the phase adjustment device 12 while simultaneously discharging pressurized medium from a second group of similarly not shown pressure chambers, the phase position of the camshaft 6, 7 can be varied relative to the crankshaft 2 in a defined angle interval. Such phase adjustment devices 12 are known in professional circles and disclosed, for example, in DE 42 18 082 A1 or DE 10 2005 060 111 A1.

The phase adjustment device 12 is arranged on an axial end of the camshaft 6, 7 and contacts an axial stop formed on the camshaft 6, 7 in the axial direction. By means of the central screw 13, the phase adjustment device 12 is locked in rotation with the camshaft 6, 7. For this purpose, the central screw 13 penetrates the phase adjustment device 12, wherein one end of the central screw 13 is constructed with a collar extending in the radial direction. The collar contacts a side surface of the phase adjustment device 12 turned away from the camshaft 6, 7. A first thread 15 is formed on the other end of the central screw 13.

The camshaft 6, 7 is constructed as a hollow shaft and has a hollow space 16 that extends along the entire camshaft 6, 7. The first fastening element 14 is arranged within the hollow space 16 and mounted on the camshaft 6, 7 fixed in position, i.e., it cannot move in the axial and radial directions. In the shown embodiment, this is realized by means of a press-fit connection between an outer lateral surface of the first fastening element 14 and a lateral surface 16*a* of the hollow space 16. The first fastening element 14 has, in a central passage borehole, a second thread 17 in which the first thread 15 of the central screw 13 engages, so that the phase adjustment device 12 is locked in rotation with the camshaft 6, 7.

A volume accumulator 18 is arranged within the hollow space 16 of the camshaft 6, 7. The volume accumulator 18 has a housing 19, a separating element 20 that is constructed as a piston 20, and a spring element 21. The housing 19 has an essentially hollow cylindrical form each with an opening 22 on each axial end side, wherein the housing 19 extends inward in the radial direction on its axial ends 23. The outer diameter of the housing 19 has a smaller construction than the diameter of the hollow space 16. The piston 20 is constructed as a thin-walled, pot-shaped sheet-metal component and supported so that it can move in the axial direction within the housing 19. Here, the piston 20 separates the interior of the housing 19 into a storage space 24 and a complementary space 25.

The spring element 21 is arranged in the complementary space 25 and is supported, on one side, on the side of the piston 20 turned away from the storage space 24 and, on the other side, on the area of the housing 19 extending inward in the radial direction.

Figure 3:
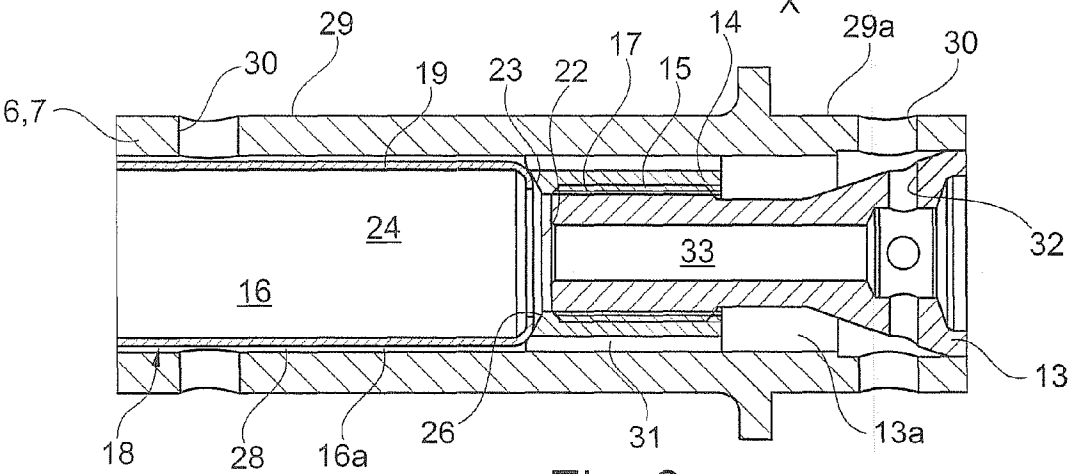

The axial ends 23 of the housing 19 each contact a conical contact surface 26 (FIGS. 2 and 3). The first conical contact surface 26 is constructed as an inner cone on the side of the first fastening element 14 turned away from the phase adjustment device 12. The second contact surface 26 is constructed on a second fastening element 27 that is locked in rotation with the camshaft 6, 7 and is arranged on the end of the camshaft 6, 7 turned away from the phase adjustment device 12. Here, the second contact surface 26 is constructed as an outer cone. The volume accumulator 18 is fixed by the contact of the housing 19 on the conical contact surfaces 26 in the hollow space 16 in the axial direction and centered relative to the longitudinal axis of the camshaft 6, 7. Because the outer diameter of the essentially hollow cylindrical housing 19 is less than the inner diameter of the lateral surface 16*a* of the camshaft 6, 7, a ring gap 28 is realized between the housing 19 and the lateral surface 16*a*. Thus there is no risk that the housing 19 will be deformed during the positioning in the hollow space 16 due to unevenness on its lateral surface 16*a*. This guarantees that the piston 20 does not become jammed within the housing 19, but instead can move smoothly. This eliminates cost-intensive and time-intensive cutting post processing on the lateral surface 16*a* of the camshaft 6, 7.

Figure 4:
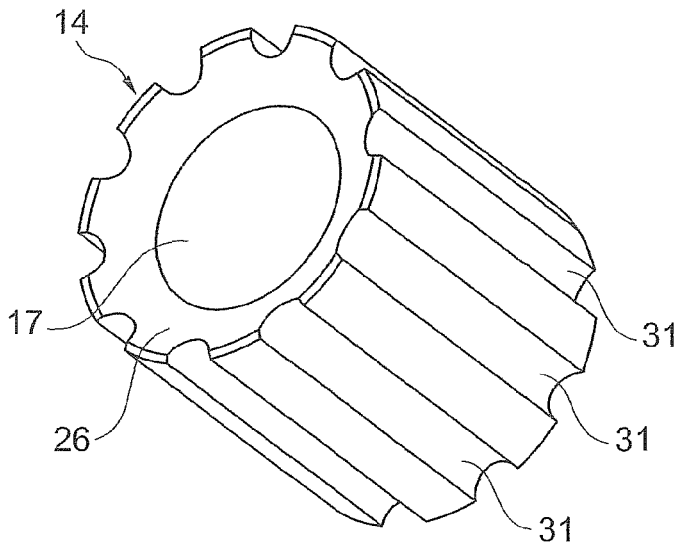

Starting from the first fastening element 14, the ring gap 28 extends along the entire camshaft 6, 7 and covers, in particular, several camshaft bearing points 29. In the area of the camshaft bearing points 29, several boreholes 30 are formed on the camshaft 6, 7 that communicate, on one side, with the ring gap 28 and, on the other side, with each camshaft bearing point 29. The ring gap 28 is sealed in the axial direction by the second fastening element 27. The first fastening element 14 has, on its outer lateral surface, first pressurized medium channels 31 in the form of grooves extending in the axial direction (FIG. 4), so that the ring gap 28 communicates with a mounting area 13*a* of the hollow space 16 in which the central screw 13 is arranged.

During the operation of the internal combustion engine 1, pressurized medium fed by a not-shown pressurized medium pump is fed by means of boreholes 30 constructed on the camshaft 6, 7 in the area of the first camshaft bearing point 29*a*. The pressurized medium is led to the camshaft bearing points 29 via the first pressurized medium channels 31, the ring gap 28, and the boreholes 30. Here, the second fastening element 27 prevents the discharge of pressurized medium on the side of the camshaft 6, 7 turned away from the phase adjustment device 12.

At the same time, the pressurized medium is led via screw openings 32 into the interior of the hollow central screw 13. Within the central screw 13, the pressurized medium is led, on one side, via a not shown, hydraulic proportional directional control valve arranged in the interior of the central screw 13 to the phase adjustment device 12. Such proportional directional control valves are known, for example, from DE 10 2005 052 481 A1. In addition, when sufficient pressurized medium is being supplied to the phase adjustment device 12, excess pressurized medium is led via a second pressurized medium channel 33 formed in the central screw 13 to the storage space-side opening 22 of the housing 19 of the volume accumulator 18 and is fed to the storage space 24. Therefore, the piston 20 is moved against the force of the spring element 21, wherein the volume of the storage space 24 increases at the expense of the volume of the complementary space 25. If the pressurized medium volume needed by the phase adjustment device 12 exceeds the pressurized medium volume supplied by the pressurized medium pump, the piston 20 is pushed in the opposite direction due to the force exerted on this piston by the spring element 21 and thus the pressurized medium stored in the volume accumulator 18 is fed via the second pressurized medium channel 33 to the phase adjustment device 12.

Thus pressurized medium is supplied to the phase adjustment device 12, the volume accumulator 18, and the camshaft bearing points 29 via the interior of the camshaft 6, 7, wherein no additional components are needed. A separate supply of pressurized medium to the camshaft bearing points 29 is not required.

The second fastening element 27 has an axial, central passage opening 34 by means of which the complementary space 25 communicates with the interior of the internal combustion engine 1. Thus, air and pressurized medium can escape from the complementary space 25.

LIST OF REFERENCE SYMBOLS

1 Internal combustion engine
2 Crankshaft
3 Piston
4 Cylinder
5 Traction mechanism drive
6 Intake camshaft
7 Exhaust camshaft
8 Cam
9 Intake gas exchange valve
10 Exhaust gas exchange valve
11 Device
12 Phase adjustment device
13 Central screw
13*a* Mounting area
14 First fastening element
15 First thread
16 Hollow space
16*a* Lateral surface
17 Second thread
18 Volume accumulator
19 Housing
20 Separating element/piston
21 Spring element
22 Opening
23 Axial end
24 Storage space
25 Complementary space
26 Contact surface
27 Second fastening element
28 Ring gap
29 Camshaft bearing point
29*a* First camshaft bearing point
30 Borehole
31 First pressurized medium channel
32 Screw opening
33 Second pressurized medium channel
34 Passage opening

The invention claimed is:

1. Device for variable adjustment of control times of gas exchange valves of an internal combustion engine, comprising a hydraulic phase adjustment device, a camshaft, a volume accumulator, a first fastening element constructed separately from the camshaft, and a central screw, the central screw penetrates the phase adjustment device, and one end of the central screw contacts an axial side surface of the phase adjustment device and a first thread is constructed on the other end, an interior of the camshaft has a hollow space in which the first fastening element is mounted fixed in position, a second thread is constructed on the first fastening element, said second thread interacts with the first thread of the central screw such that a rotationally locked connection is established between the device and the camshaft, and a volume accumulator with a housing is arranged in the hollow space, and one axial end of the housing contacts a contact surface of the first fastening element.

2. Device according to claim 1, wherein the contact surface has a conical construction in a direction of the housing.

3. Device according to claim 1, wherein the first fastening element or the central screw has a pressurized medium channel running in an axial direction, wherein said channel opens into the hollow space on a side of the first fastening element turned away from the phase adjustment device.

4. Device according to claim 3, the pressurized medium channel is constructed as a borehole within the central screw.

5. Device according to claim 3, wherein the pressurized medium channel is constructed on an outer lateral surface of the first fastening element.

6. Device according to claim 3, wherein the pressurized medium channel communicates with the volume accumulator.

7. Device according to claim 3, wherein the pressurized medium channel communicates with a camshaft bearing point.

* * * * *